United States Patent [19]

Piesik

[11] Patent Number: 4,480,522

[45] Date of Patent: Nov. 6, 1984

[54] ROCKET EXHAUST-GAS DEFLECTOR

[75] Inventor: Edward T. Piesik, Pomona, Calif.

[73] Assignee: General Dynamics, Pomona Division, Pomona, Calif.

[21] Appl. No.: 311,488

[22] Filed: Oct. 15, 1981

[51] Int. Cl.[3] ..... F41F 3/04

[52] U.S. Cl. ..... 89/1.819; 89/1.818

[58] Field of Search ..... 89/1.819, 1.818, 1.816, 89/1.8, 8

[56] References Cited

U.S. PATENT DOCUMENTS

| | | | |
|---|---|---|---|
| 2,805,898 | 9/1957 | Willis, Jr. | 406/88 |
| 3,548,708 | 12/1970 | Hibigh | 89/1.818 |
| 3,749,317 | 7/1973 | Osofsky | 239/265.19 |
| 3,796,466 | 3/1974 | Lasch, Jr. | 302/2 |
| 3,805,403 | 4/1974 | Biaggi et al. | 302/29 X |
| 3,857,321 | 12/1974 | Cohen | 89/1.816 X |
| 3,873,163 | 3/1975 | Gladish | 302/31 X |

FOREIGN PATENT DOCUMENTS

| | | |
|---|---|---|
| 220367 | 10/1957 | Australia . |
| 1918811 | 4/1969 | Fed. Rep. of Germany . |

*Primary Examiner*—David H. Brown

*Attorney, Agent, or Firm*—Henry M. Bissell

[57] ABSTRACT

Methods and apparatus are disclosed for preventing a missile's rocket exhaust gases from contacting and adversely affecting, such as by overheating, the launch rails from which a missile may be launched. Such apparatus includes orifices and pressure/flow controls in association with the rails in order to produce a cold gaseous stream directed in opposition to the exhaust gases during at least the initial phase. The stream creates a boundary plane or barrier between the rails and the exhaust gases, thereby shielding the rails from damage due to overheating.

Arrangements are provided to control the time and duration of the stream so that it may be limited to the period of actual need.

20 Claims, 5 Drawing Figures

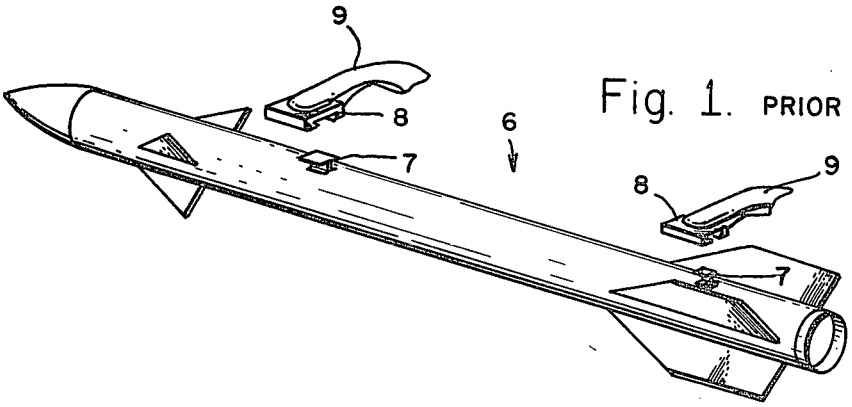
Fig. 1. PRIOR ART
Fig. 2.
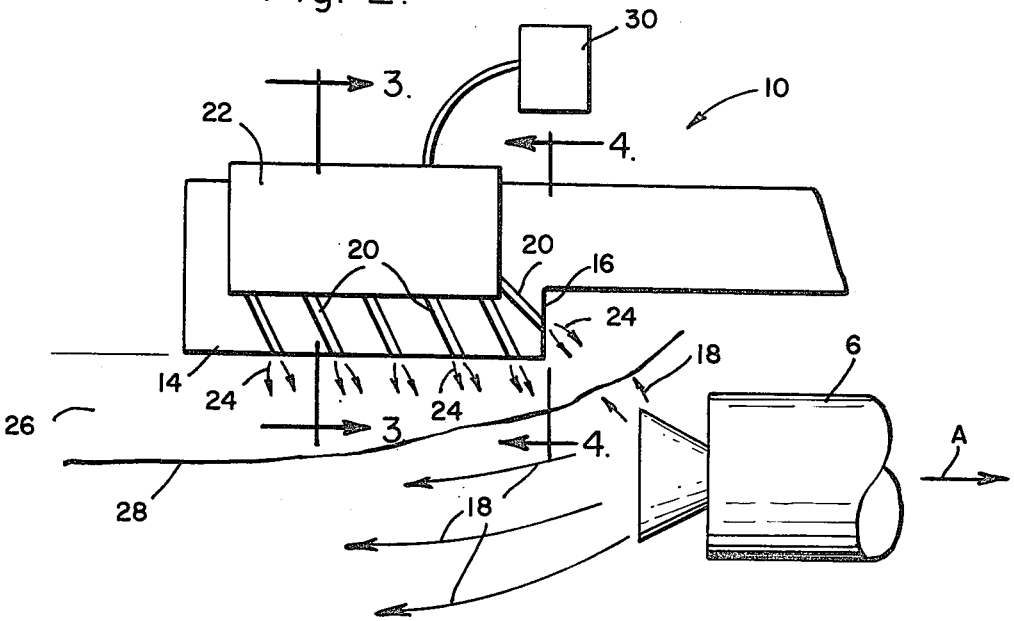
Fig. 3.
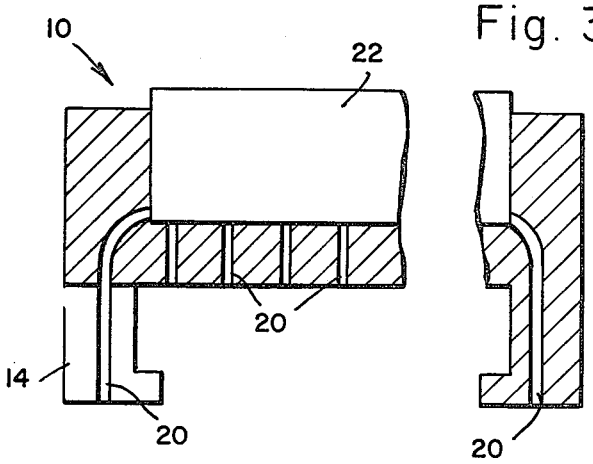

ROCKET EXHAUST-GAS DEFLECTOR

The Government has rights in this invention pursuant to Contract No. N00024-78-C-5123, awarded by the U.S. Navy.

BACKGROUND OF THE INVENTION

1. Field of the Invention.

The present invention relates to missile launching systems and, more particularly, to arrangements for preventing missile exhaust gases from contacting and overheating missile support rails during launching of the missile.

2. Description of the Prior Art.

Tactical missiles are presently launched from rails which are engulfed in the missile's rocket exhaust as the missile is fired from the launch rail. One such launch rail is shown, for example, in U.S. Pat. No. 3,983,785 of Dissmeyer et al. and comprises a pair of support brackets mounted thereon and arranged to support the rocket prior to and during launch by engaging suitable guide slots provided in the launch rail. Under single launch or multiple launch firing scenarios, the rail can become overheated, or even melt, due to the heat input of the impingement of the rocket exhaust against the launch rail.

In the firing of tactical missiles on shipboard, and possibly in other military applications, each missile in turn is supported by a pair of support arms by means of launch rails, usually two in number, which engage corresponding shoes mounted on the missiles. The missile hangs in position from the rails by means of this support arrangement and, when the missile is fired, it accelerates rapidly, the shoes disengage the rails and the missile is released. However, during its initial acceleration phase, the wash of the hot rocket exhaust engulfs the launch rail. The period of engulfment, particularly considering the extremely high temperature of the rapid exhaust, is sufficient, even though the acceleration of the missile is very rapid, to seriously damage the launch rail.

The prior art contains various examples of utilizing a pressurized chamber with perforated surfaces to develop a fluid bearing for the support and movement of items or materials relative to a support surface. Examples of such are U.S. Pat. Nos. 2,805,898 of Willis, Jr., 3,796,466 of Lasch, Jr., 3,805,403 of Biaggi et al., and 3,873,163 of Gladish. As understood, German Pat. No. 1,918,811 uses a pressurized gas stream to reduce launch rail friction. U.S. Pat. No. 3,749,317 of Osofsky describes a method of thrust vector control of a missile by utilizing controlled members in the exahust to deflect the exhaust flow of a nozzle from coming in contact with a surface to be protected. Australian Pat. No. 220,367 discloses a jet-assisted launch device in which the jets are mounted in the launcher rather than in the projectile. U.S. Pat. No. 3,548,708 of Hubigh discloses a missile launcher having an adapter piston propelled by a pneumatic charge behind the piston to propel a missile out of its launch tube prior to actual missile ignition. However, none of these prior art references teach or suggest the concept of the present invention.

SUMMARY OF THE INVENTION

In brief, arrangements in accordance wih the present invention involve one or a plurality of launch rails for supporting an associated missile and permitting the launch of the missile therefrom. Upon ignition of the missile rocket, the missile accelerates, slides off and past the launch rails, and heads toward the target.

In apparatus comprising the invention, a series of small holes are located around and/or through the rail region to be protected. Cold (ambient) gas, generally air, is passed through these holes at high pressure. The gas could, however, be stored as liquid such as nitrogen or some other inert gas which is readily storable in a compact chamber. The gas produces supersonic jets that oppose the rocket exhaust pressure, thus developing a barrier preventing the exhaust flow (and the heat contained therein) from reaching the rail surface, and thereby protecting the rail surface from adverse effects from the hot missile exhaust stream.

The required pressure of the gas jets is much less than the chamber pressure of the missile rocket motor because of the well-known pressure losses that occur when supersonic gases flow through a shock mode.

In accordance with one aspect of the invention, arrangement is provided for activating the cold gas jets only during a preselected period of time. This activation interval is adjusted to eject the gas only when the missile exhaust could possibly heat the rail, generally for an interval on the order of 0.5 seconds following ignition. For this purpose, a pressure reservoir, pressurization device, flow control and activation system are incorporated to control the gas flow and injection through the orifices to develop the gas stream with the advantageous result that the actual mass of cold gas required for each launch is relatively small.

The size, number and location of the cold gas holes in or about the launch rail can be determined analytically through state-of-the-art techniques or emperically, if need be. The object is to allow each individual jet to expand from its exit hole and protect a surrounding area of the launch rail through efficient use of the cold gas mass, pressure, hole diameter, number, angle and location.

Since convection heating due to rocket exhaust impingement occurs in the boundary layer next to the surface, it is only necessary to prevent the exhaust from reaching this surface. Thus, the height of the cold gas jet-induced deflection region can be relatively small.

In addition to protecting the launch rail from overheating due to rocket exhaust impingement, utilization of this system also serves to prevent metal oxide particles, such as aluminum oxide, which are normally present in the exhaust, from depositing on or eroding the rail surfaces. The present system also has the capability of protecting small components such as may be utilized in controlling the ignition and initial release missile (see the Dissmeyer et al. patent cited above) and which may require protection independent of the launch rails.

BRIEF DESCRIPTION OF THE DRAWINGS

A better understanding of the present invention may be had from a consideration of the following detailed description, taken in conjunction with the accompanying drawings in which:

FIG. 1 is a drawing, labelled "Prior Art", showing a conventional launch rail system for supporting a missile during launch;

FIG. 2 is a fragmentary schematic of a missile and a launch rail showing an arrangement in accordance with the present invention for preventing damage to the launch rail during firing of the missile;

FIG. 3 is a fragmentary sectional view taken substantially on the line 3—3 of FIG. 2;

DESCRIPTION OF THE PREFERRED EMBODIMENT

Figure 4:
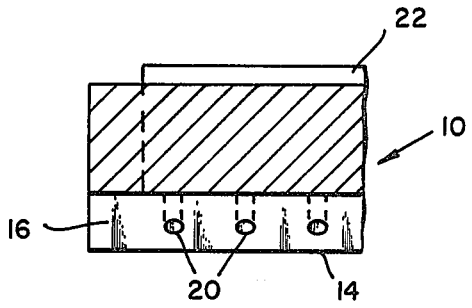
FIG. 4 is a fragmentary sectional view taken substantially on the line 4—4 of FIG. 2.

FIG. 1 illustrates a prior art arrangement, such as is used in systems like that which is the subject of the above-referenced Dissmeyer et al. patent, for the support and launching of a tactical missile. The missile 6 is shown having a pair of shoes 7 adapted to engage launch rails 8 which are respectively mounted at the outer ends of support arms 9. The launch rails 8 are each about 1 foot long (varying, possibly from about 9 to about 15 inches) and the missile itself is about 15 feet long by 1 foot in diameter. In such a prior art launching system, it is the support rails 8, particularly the after rail shown to the right in FIG. 1, which are subject to damage from the rocket exhaust of the missile 6 as it is fired.

Referring to FIG. 2, there is shown a launch rail or member 10, modified in accordance with the present invention, to protect against the exhaust 18 of the rocket 6. The rocket 6 is adapted to be launched from the rail in the direction indicated by the arrow A. For purposes of this disclosure, the launch rail 10 is shown as having surfaces 14 and 16 protected against an adverse element such as the rocket exhaust gases, indicated by the arrows 18, to prevent overheating of the launch rail 10. Overheating as defined herein refers to heating of the rail 10 to a temperature above a point that could adversely affect the structure and strength of the rail; for example, heating any part of the rail to a temperature greater than 2000° for even a fraction of a second would constitute overheating. In addition to overheating, other adverse actions by the exhaust gases 18 to the rail 10, which would normally be of ferrous material, may include corrosion, erosion or deposition of undesirable particulates upon the rail.

As best shown in FIG. 2, the surfaces 14 and 16 of the launch rail 10 are provided with a plurality of orifices or gas jet holes 20 positioned at a slight angle in the direction of travel of the rocket 12 from the launch rail 10 as shown by the arrow A. Each of the orifices 20 extends from the outer surfaces 14 and 16 to a plenum 22 for supplying pressurized gas or cold air. The pressurized gas from the plenum 22 is discharged or channeled by the orifices 20 to form a stream of gas jets 24 which are directed against the exhaust 18. The gas jets 24 discharged from the orifices 20 under high pressure produce supersonic jets of cold gas or air that oppose the rocket exhaust 18, thereby creating a deflection barrier or interaction plane 28 which serves to shield the rail 10 from adverse action by the exhaust gases. Because the deflection plane 28 is between the surfaces 14, 16 and the exhaust, the surfaces 14 and 16 are not contacted directly by the exhaust and the rail 10 is protected against damage from the exhaust.

The gas jets 24 need only be activated for the short period of time when the exhaust could heat the launch rail 10. Generally, this time period is of the order of about 0.5 seconds following ignition. This interval may be delayed slightly, if desired, to allow for the time required for the exhaust to reach the launch rail as the missile begins its launch. Also there may be times when the misile rocket motor is ignited and then shut down without launching, i.e. without releasing the missile shoes from the rails. In such event, the exhaust would not reach the support rails so that it is not necessary to activate the gas jet system.

FIG. 2 also shows a pressurization device 30 for supplying pressurized gas to the orifices 20 or to the plenum 22 coupled between the device 30 and the orifices 20 which channel the gas to form the boundary region 26.

Figure 5:
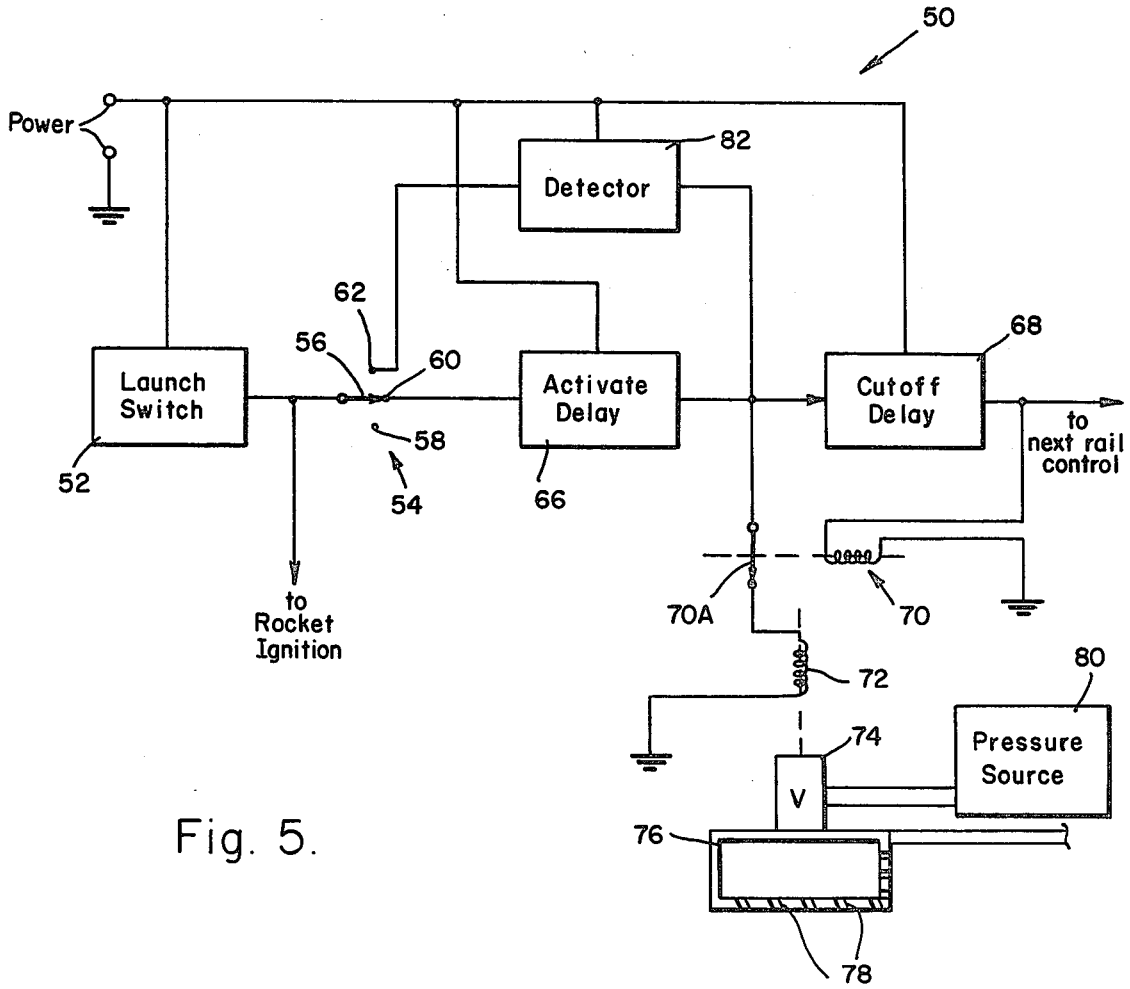
FIG. 5 is a block diagram illustrating a control system for activating the arrangement of FIG. 2.

FIG. 5 shows the apparatus of FIG. 2 in association with a system for controlling the arrangement for protecting the launch rail against impingement of the missile exhaust stream. In FIG. 5, a system 50 is shown comprising a launch switch 52, which is the switch customarily used to ignite the rocket motor of the missile. An output of the launch switch 52 is connected to a selector switch 54 having a switch armature 56 which is movable to a selected one of contact positions 58, 60 and 62. Contact 58 is the OFF position. Contact 60 is connected to an ACTIVATE DELAY stage 66, the output of which is coupled to a CUTOFF DELAY stage 68 and, via the armature 70A of a relay 70, to a solenoid 72 of a control member 74 for the rail 76 having gas jet holes 78. Control member 74 is shown connected between a pressure source 80 and the rail 76 to control the jets from the apertures 78. Contact 62 of the selector switch 54 is connected to a DETECTOR 82, the output of which is connected in parallel with the output of the ACTIVATE DELAY stage 66.

The ACTIVATE DELAY stage 66 is effective to provide an output to the CUTOFF DELAY stage 68 and to the solenoid 72 at a time following the signal from the launch switch 52 by a first predetermined delay interval, for example 0.1 seconds. The signal from the ACTIVATE DELAY stage 66 serves to energize the solenoid 72 which in turn activates the control member 74 to permit gas from the pressure source 80 to flow out through the jet holes 78, thereby establishing the interaction plane to deflect the rocket exhaust from the launch rail 76. The CUTOFF DELAY stage 68 serves to energize the relay 70 a second predetermined delay interval following the output signal from the ACTIVATE DELAY stage 66, thus opening the circuit path through the relay armature 70A and deactivating the solenoid 72 and control member 74 to terminate the gas jets through the apertures 78. The first delay interval, generated by the ACTIVATE DELAY stage 66, is related to the time required for the missile to move, during the initial launch phase, to a point where its exhaust reaches the position of the launch rail 76. The second delay interval, generated by the CUTOFF DELAY 68, is related to the time it may take the missile exhaust to pass the rail 76 and thus serves to terminate the gas jets through the apertures 78 when the danger of damage from impingement of the rocket exhaust on the launch rail 76 has passed. An output of the CUTOFF DELAY stage 68 is also shown directed to a succeeding rail control stage for providing corresponding operation in controlling a like system for pressurizing the succeeding launch rail. Such an arrangement may be desirable, although usually it is unnecessary because of the fact that by the time the missile exhaust reaches the forward launch rail, the missile velocity is such that the forward rail does not need the protection which is required for the after rail.

The DETECTOR 82, operative when the armature 56 of the selector switch 54 is in the position of contact 62, provides an alternative control channel to the ACTIVATE DELAY stage 66. In the DETECTOR mode of operation, the rail protection system is not activated until movement of the missile is initiated. This mode of control is preferable under certain circumstances of operation, as for example where missiles of differing acceleration times may be fired from the same launcher. Also, there are occasions when a missile rocket motor may be ignited and then shut down while the missile is not released by the launcher. The DETECTOR 82 may, for example, be a photocell positioned to respond to the rocket exhaust after the missile has moved a predetermined distance. Alternatively, it may comprise a microswitch located to detect initial movement of the missile or it may be some other mechanism for detecting release of the missile from the launcher during launch. Once the output signals is provided by the DETECTOR 82, activation and cutoff of the gas jet system proceeds in the manner already described for the ACTIVATE DELAY mode.

The activation member 74 may comprise any one of a number of alternative devices for controlling the jets through the apertures 78. For example, it may be a valve which is opened and closed by the associated solenoid 72, thus permitting pressurized gas from the pressure source 80 to reach the chamber within the rail 76 and thereafter exit the apertures 78. Alternatively, it may comprise a shutter mechanism serving to open and close the apertures 78 under the control of the solenoid 72.

From the foregoing, it will be appreciated that the present invention provides a simple and effective method for preventing a missile's rocket exhaust from impinging upon and damaging the launch rail from which the missile is fired. The provision of orifice means at selected regions of the rail to be protected against the exhaust gases, and the control of pressurized gas to the orifice means to produce a gaseous stream of supersonic gas jets angularly disposed to direct the stream substantially in opposition to the direction of action of the gases of the rocket exhaust, result in the creation of an interaction plane between the rail or rails and the exhaust gases which prevents the exhaust from penetrating the region and contacting and overheating the launch rail.

Although there have been described above specific arrangements and methods for preventing overheating of a launch rail in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A method of shielding a member normally exposed to rocket exhaust during launching of a missile comprising the steps of:

providing a plurality of gas jet orifices distributed over the exterior surface of said member;

selectively applying pressurized gas to said orifices to develop a protective plane over said surface; and limiting the time duration of said protective plane in accordance with the passage of the rocket exhaust adjacent said surface.

2. The method of claim 1 further including the step of directing gas jets through said orifices substantially in opposition to the direction of the rocket exhaust impinging said surface.

3. The method of claim 1 wherein the member to be shielded is a launch rail having a hollow chamber with a plurality of orifices extending from the chamber to the exterior surface adjacent the rocket exhaust, and including the step of providing gas from a pressurized gas source to the chamber for a predetermined period of time.

4. The method of claim 1 further including the step of pressurizing said orifices in response to the launching of the missile.

5. The method of claim 4 wherein the orifice pressurizing step includes pressurizing the orifices upon detection of movement of the missile during launch.

6. The method of claim 4 wherein the pressurizing step includes delaying orifice pressurization by a predetermined first delay interval following a signal initiating launch.

7. The method of claim 6 further including the step of discontinuing orifice pressurization a predetermined second delay interval following pressurization of the orifices.

8. The method of claim 7 wherein the second delay interval is selected to correspond to the time during which the rocket exhaust is present at the surface to be protected.

9. A method of preventing exhaust from a rocket-propelled missile from impinging upon and overheating a rail from which the missile is launched, comprising the steps of:

supplying pressurized gas to produce a plurality of gas jets at selected surface regions of the rail to be protected from the exhaust;

directing the gas jets toward the exhaust to produce a deflection plane adjacent the selected surface regions preventing the exhaust from penetrating the deflection plane and overheating the rail; and selectively limiting the time duration of the deflection plane in accordance with the passage of the rocket exhaust adjacent the selected surface regions of the rail.

10. Apparatus for shielding a member normally exposed to rocket exhaust during launching of a missile comprising:

a source of pressurized gas;

means coupled to said source for directing the pressurized gas to impinge the gases of the rocket exhaust and develop a protective plane at the juncture of the pressurized gas and the rocket exhaust substantially covering the surface of the member to be protected, said plane serving to prevent rocket from exhaust reaching said surface; and means for controlling the directing means for a time interval corresponding to the presence of said rocket exhaust in the vicinity of said member;

wherein the directing means includes a plurality of orifices extending through the surface of the member and oriented toward the region of the rocket exhaust and the controlling means includes means for selectively pressurizing the orifices during a predetermined time interval;

the selectively pressurizing means including means for delaying the orifice pressurization by a first time interval selected in accordance with the initial acceleration of the missile.

11. The apparatus of claim 10 including means for initiating orifice pressurization in response to a missile launch signal.

12. The apparatus of claim 11 wherein said last-mentioned means comprises a selector switch for selecting one of a pair of alternate activation modes.

13. The apparatus of claim 10 wherein the selectively pressurizing means includes means for initiating pressurization in response to motion of the missile during the initial launch phase.

14. The apparatus of claim 8 further including a detector for detecting missile movement during launch and coupled to provide a signal to initiate pressurization.

15. The apparatus of either of claims 10 or 8 including means for terminating orifice pressurization a second predetermined interval after initiation of pressurization.

16. The apparatus of claim 15 wherein the second predetermined interval is selected to correspond to the time during which the exhaust is adjacent the member.

17. The apparatus of claim 10 wherein the member comprises a launch rail including a chamber therein coupled between the source of pressurized gas and the directing means, and wherein the controlling means includes means for selectively applying pressurized gas to said chamber.

18. The apparatus of claim 17 wherein the orifices extend from said chamber to the exterior surface of the launch rail for providing a plurality of gas jets to develop said protective plane.

19. The apparatus of claim 18 wherein said orifices are arranged to develop supersonic flow of the gas jets therethrough.

20. The apparatus of claim 18 wherein said orifices are formed to direct the gas jets at a predetermined angle relative to the surface of the launch rail, which angle is selected to direct the jets to oppose impingement of the rocket exhaust.

* * * * *